US008668122B2

(12) United States Patent
Case et al.

(10) Patent No.: US 8,668,122 B2
(45) Date of Patent: Mar. 11, 2014

(54) TABLET ACCESSORY SYSTEM

(75) Inventors: Richard N. Case, Boulder, CO (US); Dennis Balchunas, Longmont, CO (US)

(73) Assignee: Nite Ize, Inc., Boulder, CO (US)

( * ) Notice: Subject to any disclaimer, the term of this patent is extended or adjusted under 35 U.S.C. 154(b) by 168 days.

(21) Appl. No.: 13/196,669

(22) Filed: Aug. 2, 2011

(65) Prior Publication Data

US 2012/0024917 A1 Feb. 2, 2012

Related U.S. Application Data

(60) Provisional application No. 61/369,816, filed on Aug. 2, 2010, provisional application No. 61/409,417, filed on Nov. 2, 2010.

(51) Int. Cl.
*A45F 5/00* (2006.01)

(52) U.S. Cl.
USPC ..... 224/218; 224/222; 224/577; 224/578; 224/580; 224/605; 224/661; 224/677; 224/930

(58) Field of Classification Search
USPC ..... 224/218, 222, 257, 258, 577–580, 583, 224/604, 605, 625, 661, 677, 930
See application file for complete search history.

(56) References Cited

U.S. PATENT DOCUMENTS

| | | | | |
|---|---|---|---|---|
| 4,793,575 | A | 12/1988 | Butler | |
| 5,937,765 | A * | 8/1999 | Stirling | 108/43 |
| 6,182,878 | B1 * | 2/2001 | Racca | 224/605 |
| 7,278,966 | B2 | 10/2007 | Hjelt et al. | |
| 7,327,562 | B2 * | 2/2008 | Littlepage | 361/679.55 |
| 7,414,833 | B2 * | 8/2008 | Kittayapong | 361/679.27 |
| 7,778,026 | B2 * | 8/2010 | Mitchell | 361/679.55 |
| 2002/0047033 | A1 * | 4/2002 | Harada et al. | 224/661 |
| 2003/0136808 | A1 * | 7/2003 | Kelson | 224/602 |
| 2004/0144819 | A1 * | 7/2004 | Huang | 224/583 |
| 2007/0001079 | A1 | 1/2007 | Patterson | |
| 2007/0027616 | A1 | 2/2007 | Masson | |
| 2007/0235492 | A1 * | 10/2007 | Sirichai et al. | 224/930 |
| 2008/0043416 | A1 | 2/2008 | Narayan | |
| 2009/0219677 | A1 * | 9/2009 | Mori et al. | 361/679.03 |

OTHER PUBLICATIONS

International Search Report from PCT/US11/46297 dated Jan. 10, 2012, 3 pages.

* cited by examiner

*Primary Examiner* — Adam Waggenspack
(74) *Attorney, Agent, or Firm* — Patton Boggs LLP

(57) ABSTRACT

A tablet computer accessory system for holding a tablet computer includes a base; a plurality of holding straps extending from the base, the plurality of straps each forming a loop, each loop oriented on a corner of the tablet computer; a lanyard interconnected with the base; a handle interconnected with the base; a hanging strap interconnected with a carabineer, the hanging strap attached to the base; and a leg strap interconnected with the base.

15 Claims, 12 Drawing Sheets

TABLET ACCESSORY SYSTEM

CROSS REFERENCE TO RELATED APPLICATIONS

This application claims the benefit of U.S. Provisional Patent Application Ser. No. 61/369,816 filed on Aug. 2, 2010, and U.S. Provisional Patent Application Ser. No. 61/409,417 filed Nov. 2, 2010. The entirety of both applications is incorporated by reference herein.

BACKGROUND

Tablet computers such as the iPad® are quickly becoming popular computing devices. Such computers may be used in a variety of contexts for personal, business, and educational activities. The customization possibility and the quick usability of these devices have made them popular. The tablet computer can be used for a multitude of activities; however, ready accessibility is key in a variety of contexts such as business, sales, navigation, etc.

At the same time, although the durability of these devices is increasing, the tablet computer is subject to breakage if dropped. While a case may protect against such damage, access to the touch screen of the tablet computer may be limited by the usage of a case and require the user to open and close the device. Also, the case may not provide a mechanism for securing the device to the body or another object when not in use. A system is needed for quick attachment configurations, carrying configurations, and holding configurations to increase the ability to use tablet computers in business and educational settings, as well as for navigation and other intensive activities.

SUMMARY

In one embodiment, a method of holding a tablet computer includes providing an accessory system, the accessory system including: a base; a plurality of holding straps extending from the base, the plurality of straps each forming a loop, each loop oriented on a corner of the tablet computer; a lanyard interconnected with the base; a handle interconnected with the base; a hanging strap interconnected with a carabineer, the hanging strap attached to the base, and a leg strap interconnected with the base. The method further includes configuring the accessory system in a handheld configuration by detaching the lanyard and leg strap and storing of the carabineer interior to the handle and placing a hand of the user in the handle.

In one alternative, the user may further configure the accessory system in a lanyard configuration by attaching the lanyard and placing the lanyard around a body of the user. In another alternative, the user may further configure the accessory system in a leg strap configuration by removing the handle and detaching the carabineer and lanyard. In another alternative, an accessory bag is further provided for stowing detached articles of the accessory system.

In one embodiment, a tablet computer accessory system for holding a tablet computer includes: a base; a plurality of holding straps extending from the base, the plurality of straps each forming a loop, each loop oriented on a corner of the tablet computer; a lanyard interconnected with the base; a handle interconnected with the base; a hanging strap interconnected with a carabineer, the hanging strap attached to the base, and a leg strap interconnected with the base. In one alternative, the base is padded on a side that receives the tablet computer. In another alternative, the base has a rubberized, high friction surface on a side that receives the tablet computer. Alternatively, each of the plurality of holding straps is elastic, such that they stretch around the tablet computer and provide tension to hold it in place. Alternatively, there are four holding straps. In yet another alternative, each one of the four holding straps is oriented to align with one of the four corners of the tablet computer. Alternatively, the length of the loop formed by each of the four holding straps is adjustable. In another alternative, the system further includes an accessory bag. In one alternative, the handle is removable. In another alternative, the handle is a square piece of material with Velcro® at either end and is mounted on a strap, such that the handle folds around the strap and fastens together with the Velcro®. Alternatively, the handle forms a pocket for insertion of and storage of the carabineer. In yet another alternative, the tablet computer accessory system has four configurations: a handheld configuration, a hanging configuration, a lanyard configuration, and a leg strap configuration. Alternatively, the handheld configuration is characterized by detachment of the lanyard and leg strap and storage of the carabineer interior to the handle. Optionally, the hanging configuration is characterized by the attachment of the carabineer to a fixed point. Alternatively, the lanyard configuration is characterized by the orientation of the lanyard around a user. In one alternative, the leg strap configuration is characterized by the removal of the handle and the detachment of the carabineer.

In one embodiment, a tablet computer accessory system for holding a tablet computer includes a base and a plurality of holding straps extending from the base, the plurality of straps each forming a loop. Each loop is oriented on a corner of the tablet computer and the plurality of holding straps is elastic. Each of the plurality of holding straps engages a corner of the tablet computer and an angle that the holding straps crosses a side of the tablet computer is acute to a portion of the side of the tablet computer closest to the corner. The system includes at least one accessory for attaching the tablet computer accessory system to various objects, articles, or parts of a user.

DETAILED DESCRIPTION

Figure 1:
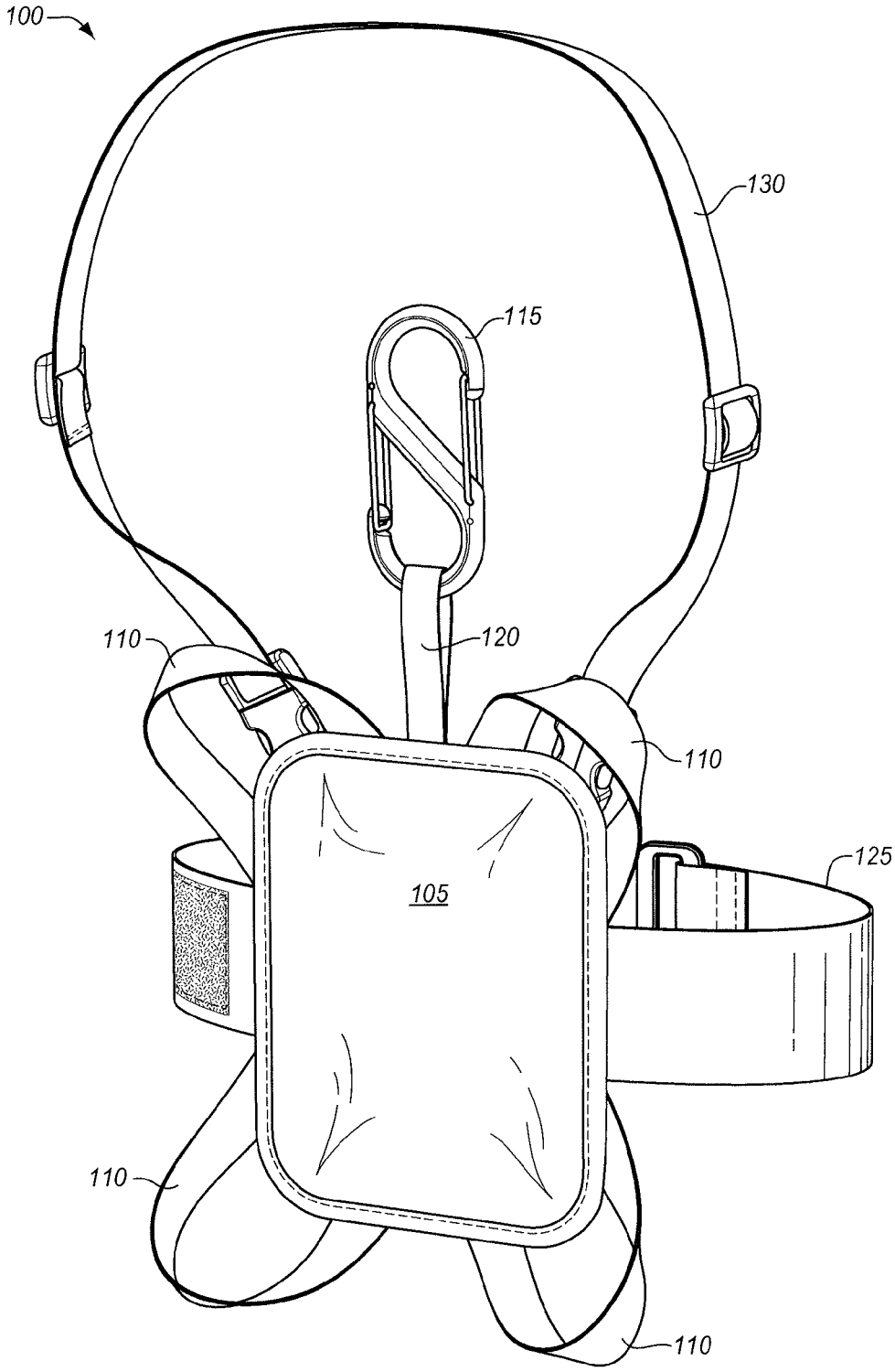
FIG. 1 shows a front view of one embodiment of a tablet accessory system.

FIG. 1 shows one embodiment of a tablet accessory system 100. Tablet accessory system 100 includes a variety of attachment and holding mechanisms, as well as a place for a tablet computer to be attached. A tablet computer may be attached to base 105 by utilizing corner straps 110. In the embodiment shown, base 105 is padded. In an alternative, base 105 includes a surface with a high level of friction, such as molded rubber, to further provide resistance against the movement of the tablet computer. In the embodiment shown, corner straps 110 are elastic so that they can stretch to accommodate and hold a tablet computer. In one alternative, the corner straps are elastic neoprene. Although the design of the tablet accessory system is complementary to a tablet computer, numerous other items could be mounted in tablet accessory system 100.

Tablet accessory system 100 includes an S-Biner™ 115 and attachment strap 120. S-Biner™ 115 allows tablet accessory system 100 and accompanying tablet computer to be hung or connected to a variety of items including, but not limited to, a backpack, a belt, a belt loop, a wall hook, etc. Tablet accessory system 100 further includes a leg strap 125. Tablet accessory system 100 further includes a lanyard 130 that has an adjustable length. Lanyard 130 is removable via side release buckles 135.

Figure 2:
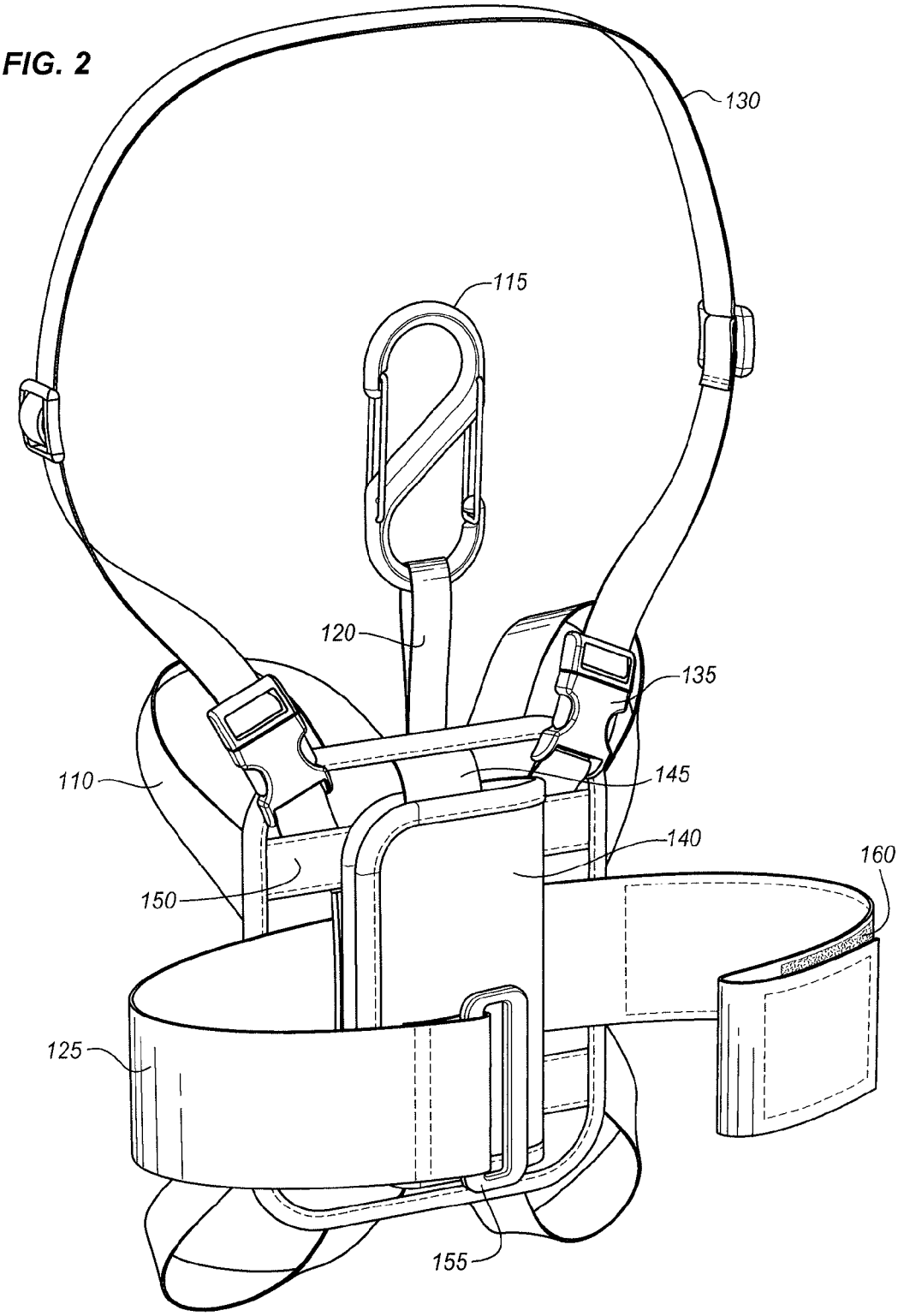
FIG. 2 shows a rear view of the tablet accessory system.

FIG. 2 shows a rear view of tablet accessory system 100. In this view, handle 140 is viable, as is Velcro® attachment strap 145. Attachment panel 150 reveals how the construction of tablet accessory system 100 is performed. Panel 150 reinforces the attachment of the lanyard 130. Leg strap 125 is also visible, as is the Velcro® portion 160 which fits into buckle 155.

Figure 3:
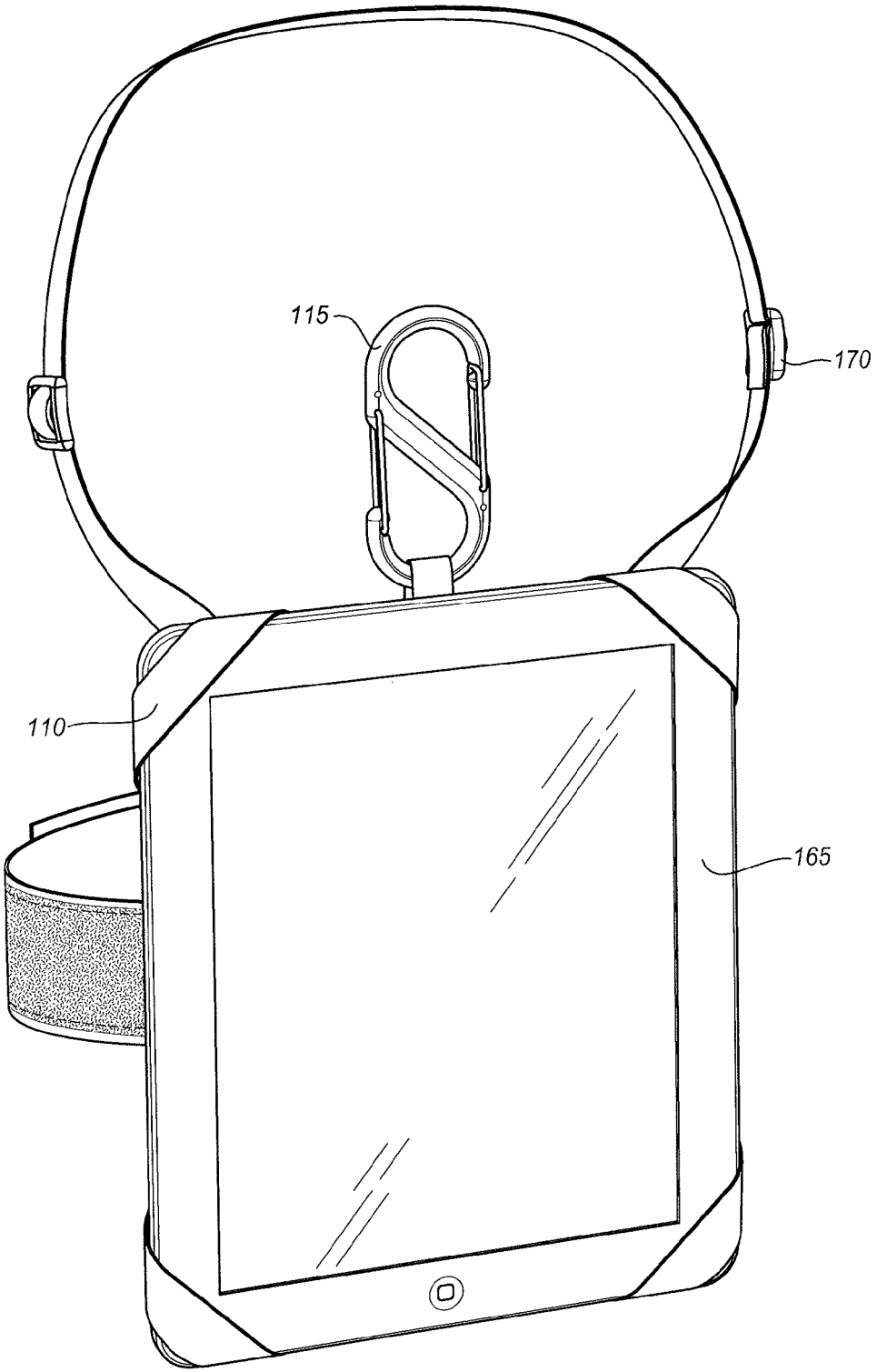
FIG. 3 shows the same view as FIG. 1 with a tablet computer inserted into the tablet accessory system.

FIG. 3 shows tablet accessory system 100 with a tablet computer 165 inserted. Corner straps 110 secure tablet computer 165 on all four corners while not interfering with the touch screen interaction of tablet computer 165. The angle of the corner straps provide for resistance against movement in all directions.

Figure 4:
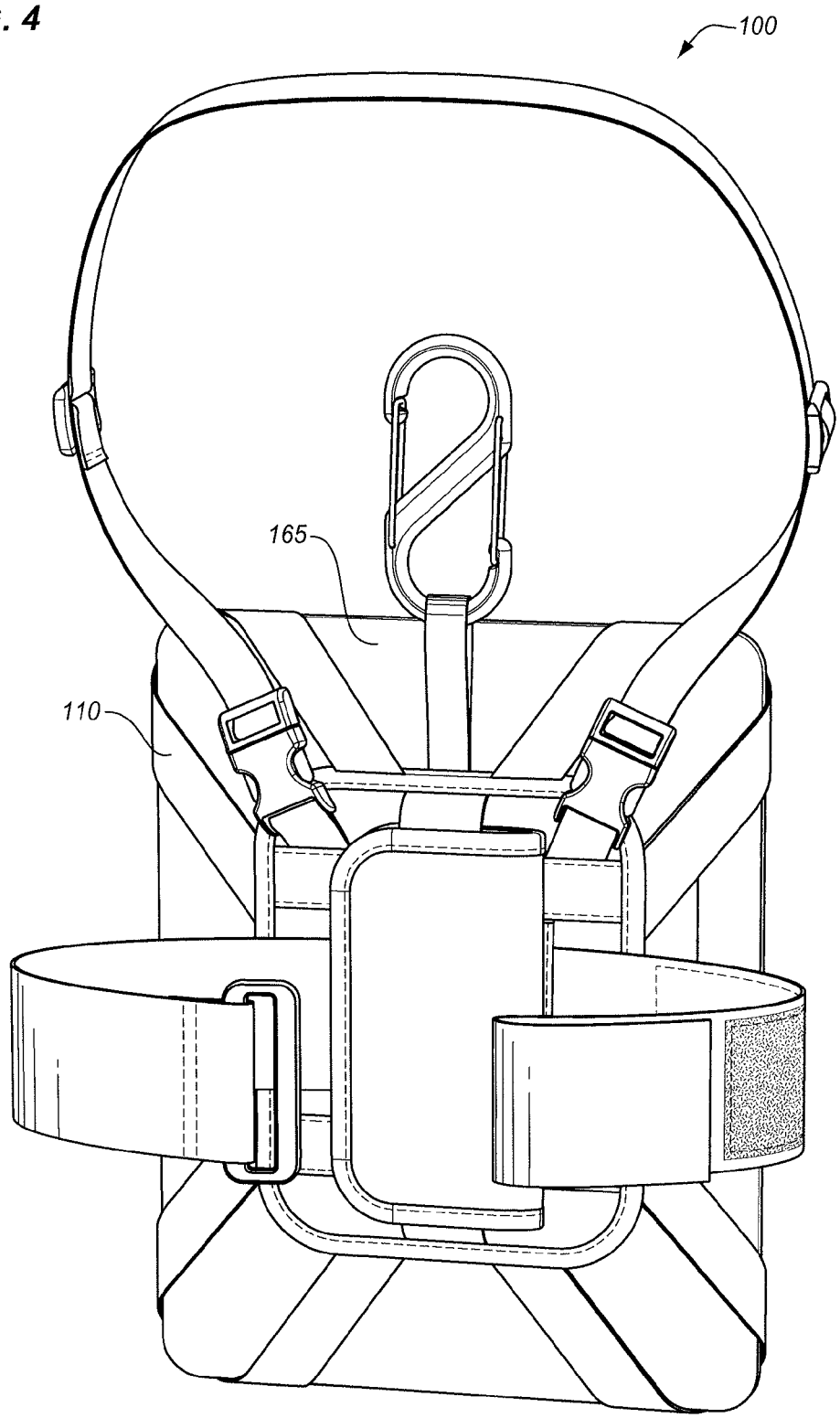
FIG. 4 shows a rear view of the tablet accessory system with a tablet computer inserted.
Figure 5:
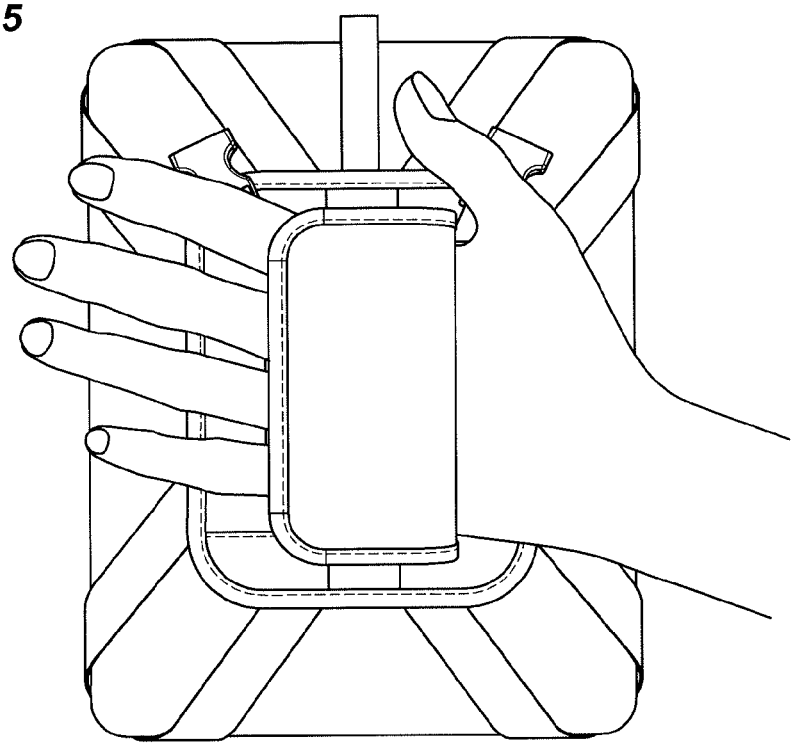
FIG. 5 shows a rear handle of the tablet accessory system as utilized by a hand.

FIG. 4 shows a rear view of tablet accessory system 100 with a tablet computer 165 inserted. The extension of straps 110 is clear in this figure. FIG. 5 shows the usage and sizing of handle 140. This handle 140 allows the user to easily hold and manipulate the tablet computer 165 in a secure fashion, while retaining complete access to the touch screen interface. Handle 140 may be slid up the wrist of the user, allowing for the usage of both hands while maintaining ready access to tablet computer 165.

Figure 6:
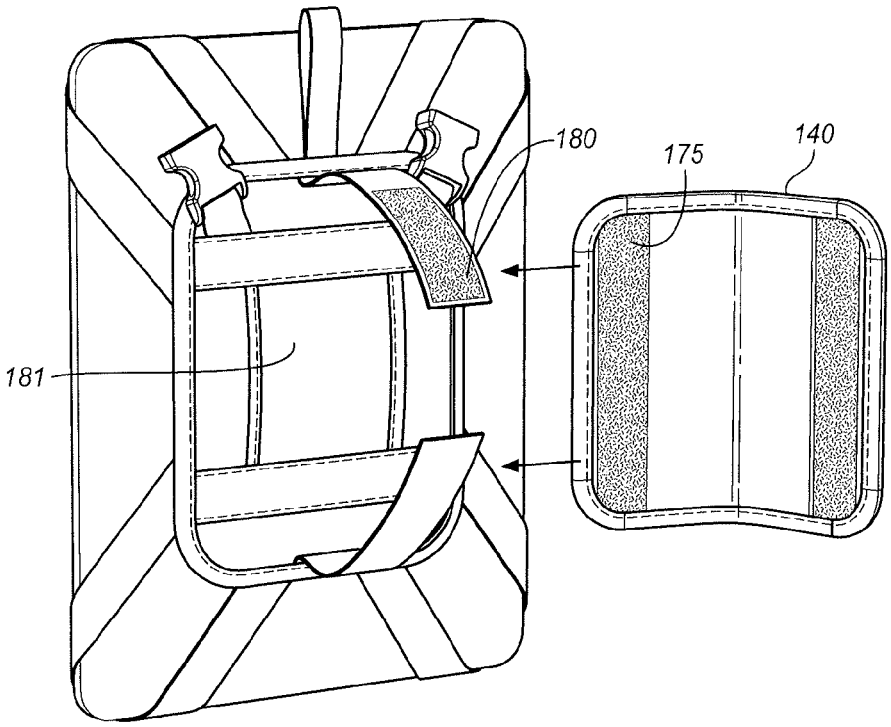
FIG. 6 shows detachment of the rear handle of the tablet accessory system.

FIG. 6 shows the removal of handle 140. Handle 140 has Velcro® portions 175, and strap 145 has Velcro® portions 180 to enable removal. Loop 181 also can be seen in this figure. Loop 181 supports leg strap 125. In one alternative, leg strap 125 is elastic neoprene. Alternatively, the user may put a longer belt or other strap through loop 181.

Figure 7:
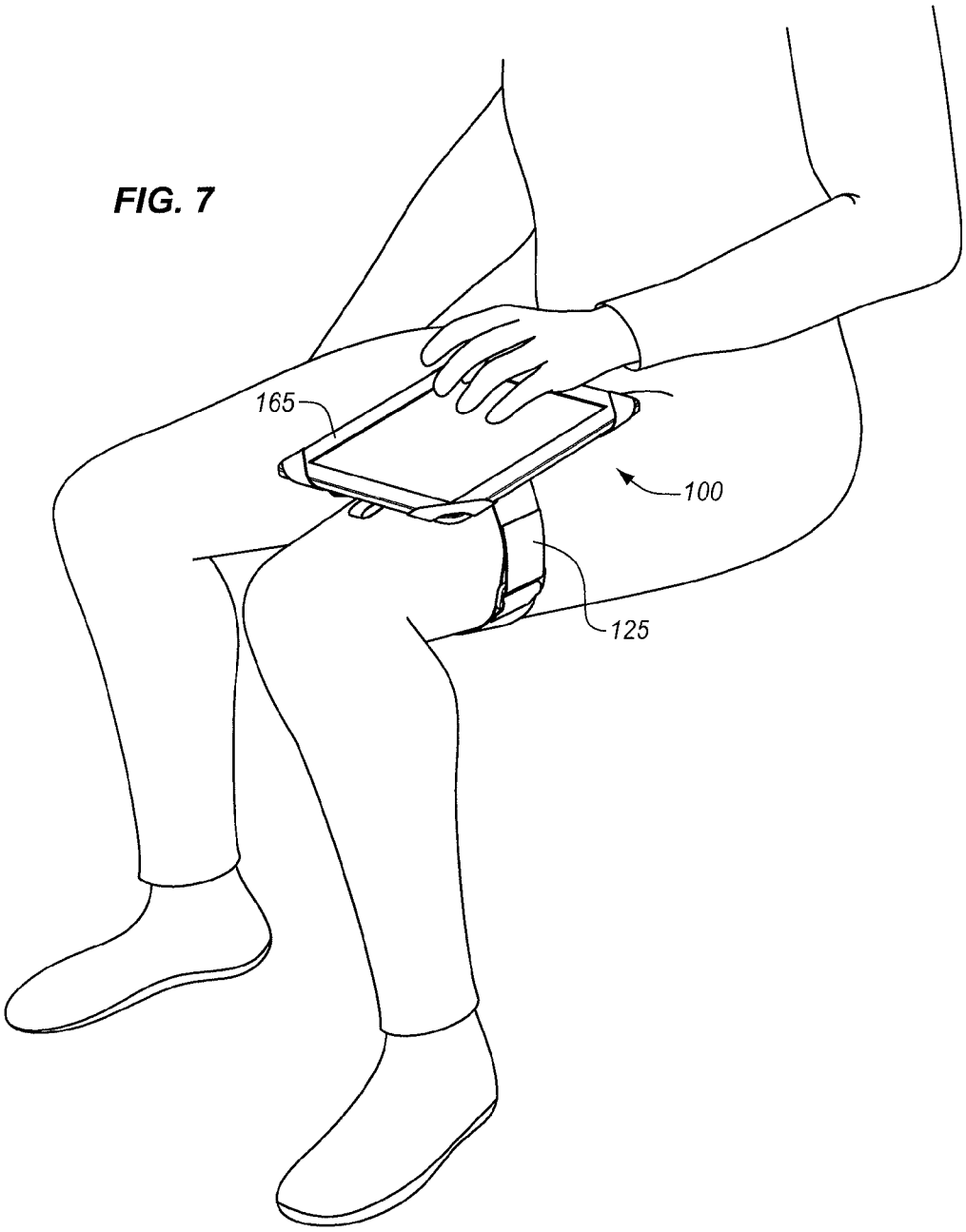
FIG. 7 shows the tablet accessory with the leg strap utilized.

FIG. 7 shows the usage of leg strap 125. Leg strap 125 allows the user to mount tablet computer 165 on a leg. This configuration may be useful for those flying/navigating airplanes and those sailing/navigating ships. Specialized applications are available for many tablet computers providing for navigation assistance in such activities. Another possible activity is car navigation using a GPS system. In an alternative, a shorter strap is used than leg strap 125, which will allow the user to mount tablet computer 165 on the interior portion of the forearm, allowing the user to be hands free while providing ready access to tablet computer 165.

Figure 8:
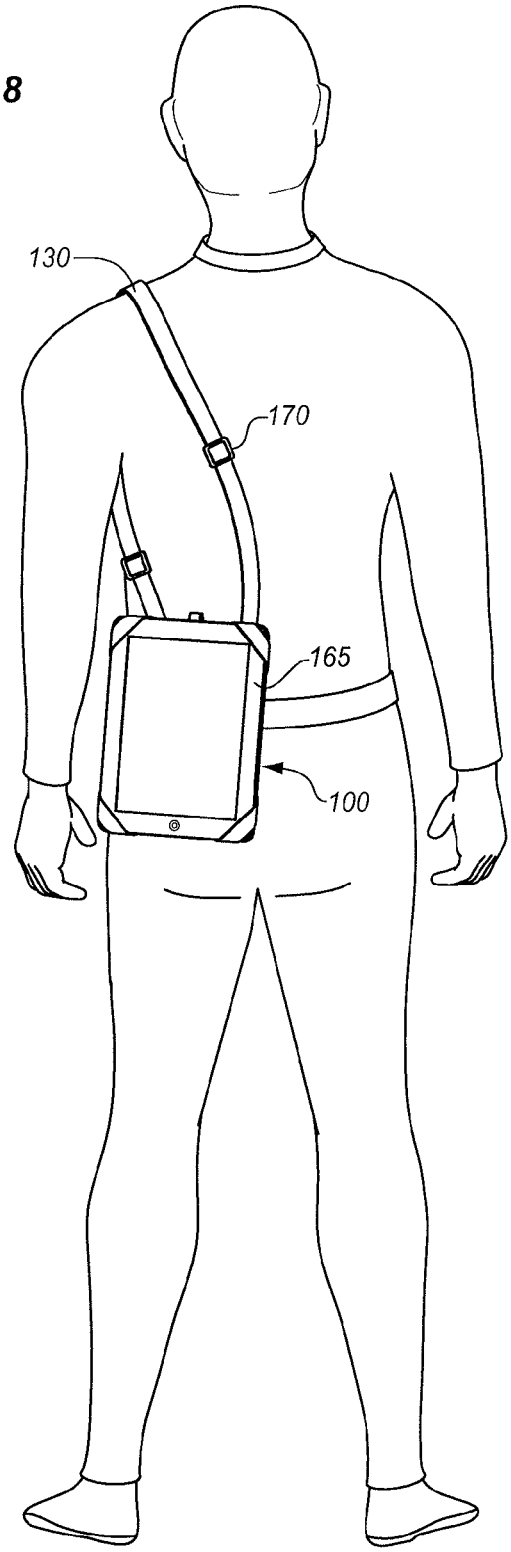
FIG. 8 shows the tablet accessory system with the shoulder strap utilized.
Figure 9:
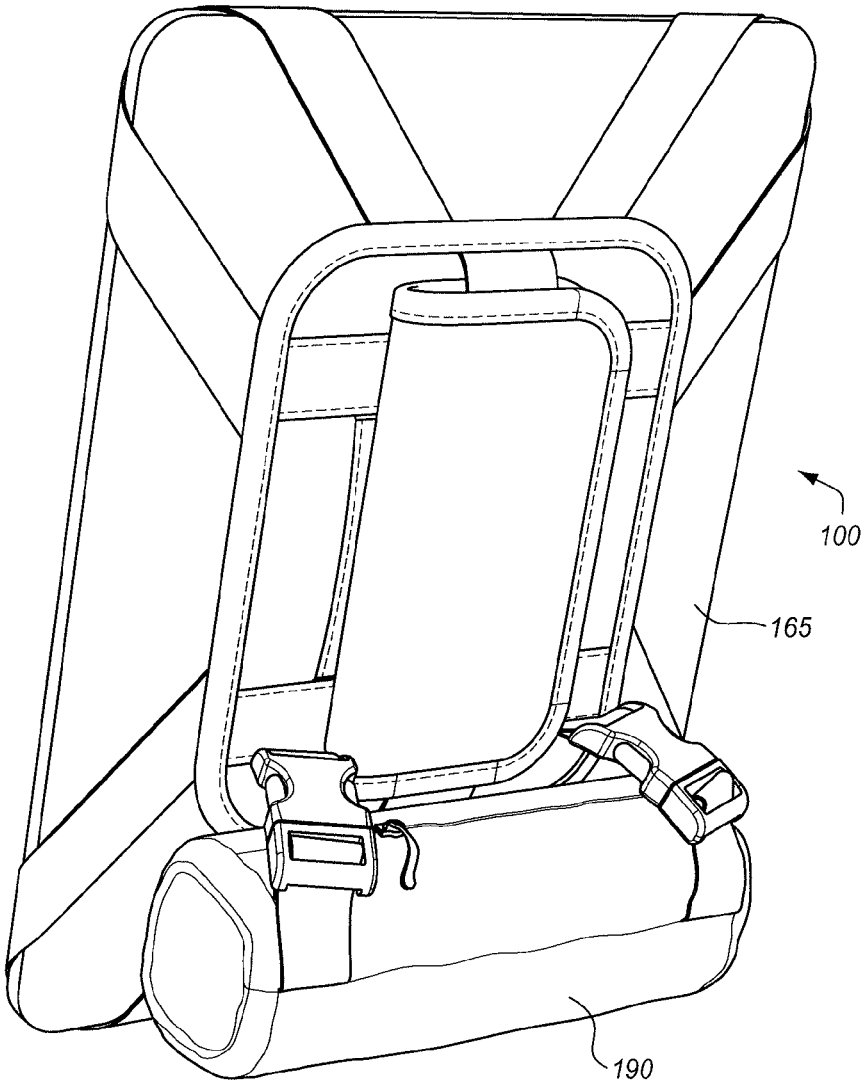
FIG. 9 shows a rear view of the tablet accessory system with the accessory bag used as a stand.

FIG. 8 shows the usage of lanyard 130. Lanyard 130 includes two slide adjusters 170 for ready adjustment of the strap length. In this way, the user may cinch lanyard 130 tightly around the body and around the neck allowing for secure attachment. Alternatively, the user may place lanyard 130 solely around the neck and position the base of tablet computer 165 against the body, which will provide the touch screen in a position parallel to the ground. FIG. 9 shows the attachment of accessory bag 190. Lanyard 130 has been removed and side release clips 135 have been attached to accessory bag 190. This allows for storage of lanyard 130 and leg strap 125. Further, as shown in FIG. 9, the addition of accessory bag 190 serves to form a stand for tablet computer 165. Tablet computer 165 is leaned against the accessory bag, providing for a substantially upright position for tablet computer 165. Accessory bag 190 will not easily slip due to the attachment to tablet computer accessory system 100 via the side release buckles 135. Even though the configuration will be upside-down from the lanyard configuration, since tablet computers typically have accelerometers, the screen will automatically flip.

In one alternative, tablet computer accessory system 100 is attached to a headrest in a car for viewing. In this configuration, the leg strap 125 is used to tension around the head rest. This can provide for movie viewing, game playing, etc. on car trips.

Figure 10:
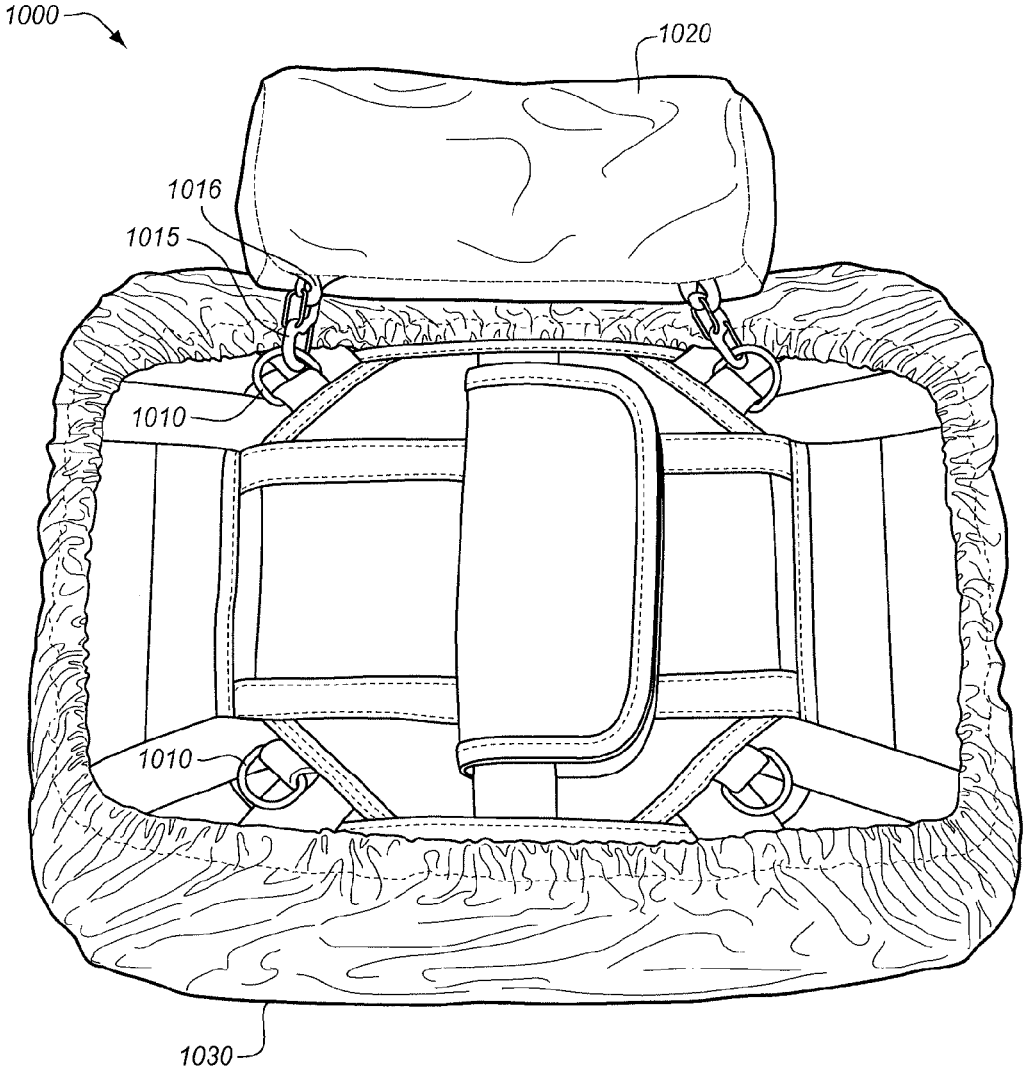
FIG. 10 shows an alternative embodiment of a tablet accessory system with a screen cover.
Figure 11:
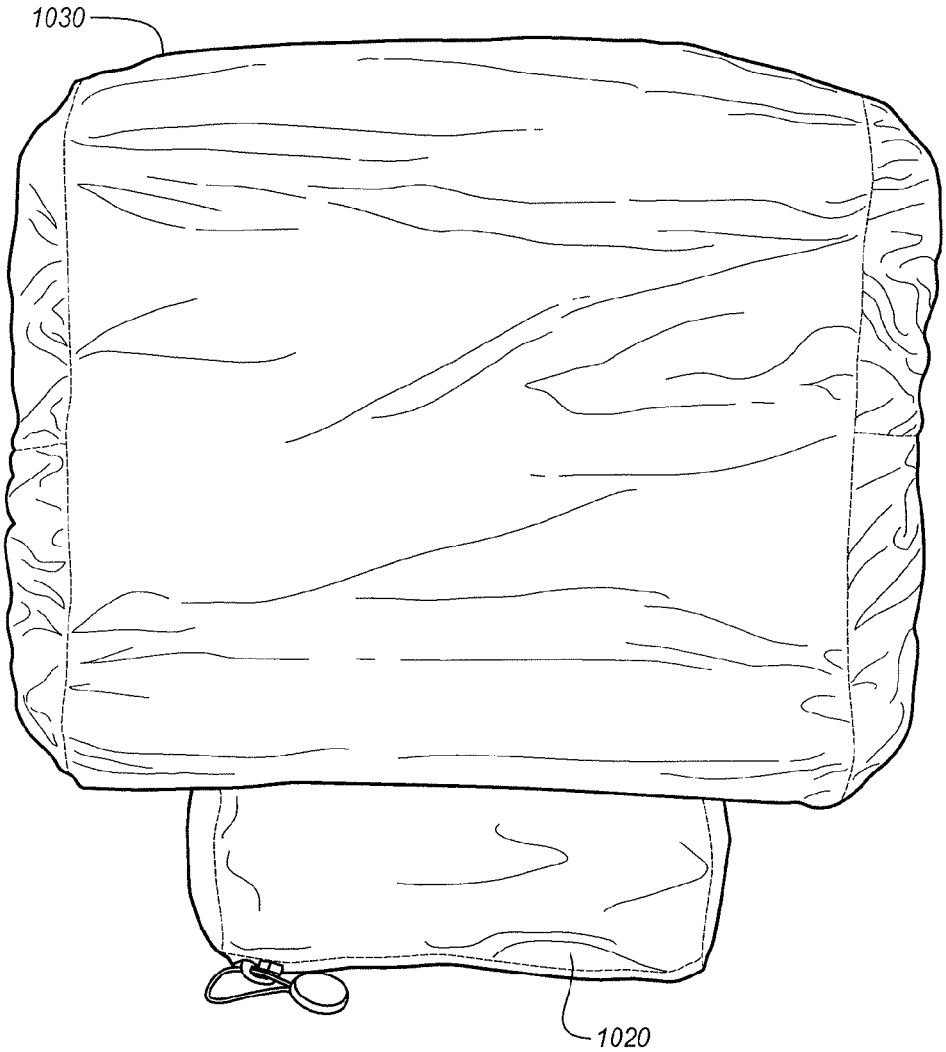
FIG. 11 shows a view of the opposite side of the tablet accessory system of FIG. 10.

FIG. 10 shows an alternative embodiment, tablet computer accessory system 1000. Tablet computer accessory system 1000 includes many of the same features as tablet computer accessory system 100. Tablet computer accessory system 1000 also includes attachment rings (D Rings) 1010, S-Biners 1015 and accessory bag 1020. In some alternatives, S-Biners 1015 may be a regular carabineer or other attachment device. The use of attachment rings 1010 and the S-Biners 1015 allows for the accessory bag 1020 to be attached in a variety of configurations, similar to as shown in FIG. 9, but with greater flexibility. In this way, the tablet computer can be stood in either a portrait or landscape configuration. Furthermore, the lanyard and other attachments described in relation to the previous embodiment may be oriented in a variety of configurations connecting to attachment rings 1010 and S-Biners 1015. Instead of attachments for side release buckles, the associated lanyard and accessory bag 1020 have loops 1016 for attachment using S-Biners 1015. FIG. 11 shows a view from the opposite side. The use of attachment rings 1010 and S-Biners 1015 also allow for multiple accessories to be attached at once.

FIG. 10 also shows cover 1030. Optionally, the material of cover 1030 used in this embodiment may be thin material that is waterproof such as a rip stop nylon that is used to make tents. The material of cover 1030 can be compressed into a small size and fit into the accessory bag, or it can be incorporated to fit in a pocket that can be added under the handle 140 and remain attached (to prevent loss) so as to provide quick access.

Figure 12:
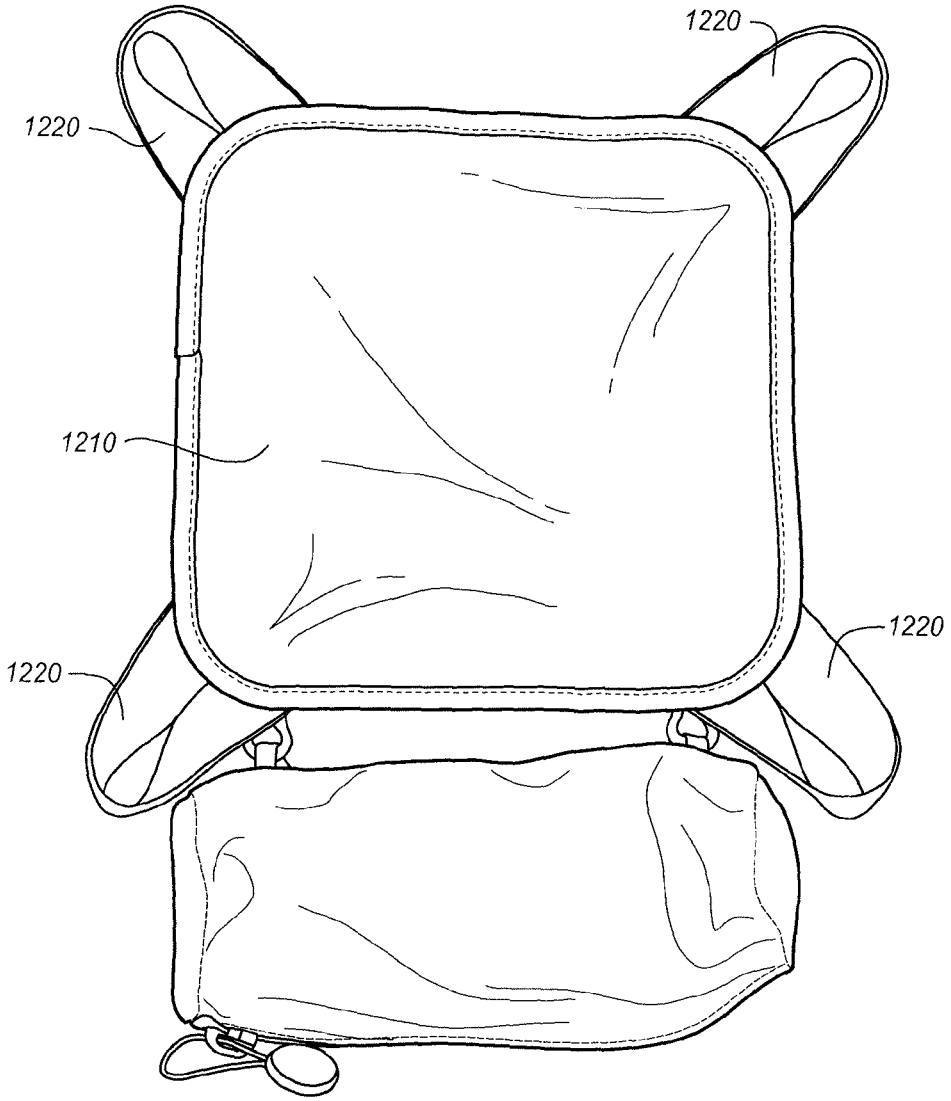
FIG. 12 shows a view of the tablet accessory system of FIG. 10 with the tablet computer removed.
Figure 13:
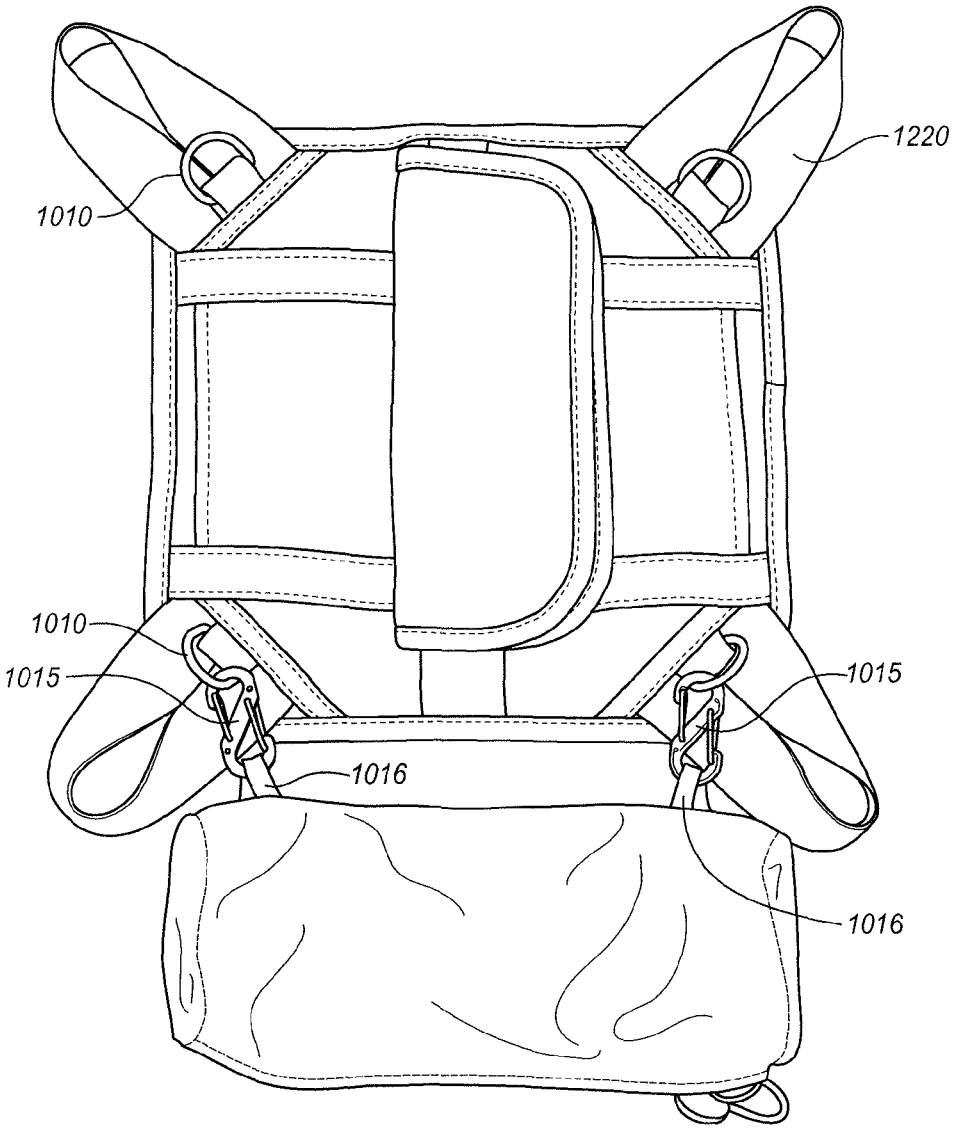
FIG. 13 shows a view of the opposite side of the tablet accessory system of FIG. 12.

FIG. 12 shows base 1210 and attachment straps 1220. These differ from the previous embodiment in that the base is square, which allows for the same attachment tension in either portrait or landscape orientation. The tension on straps 1220 may be manufactured accordingly. FIG. 13 is a rear view of the device of FIG. 12. The piece allows for screen protection from the elements or during storage. Optionally, material on the base 1210 (seen in FIG. 13) is a coated rubber that allows for better grip to the device and allows the accessory bag to create more friction and not slip when using the system as a stand.

Utilizing the straps and other attachments provides various configurations of the tablet accessory system 100. In all of the embodiments, it is not necessary to include all attachments. In one embodiment, including a tablet computer accessory system for holding a tablet computer, the tablet accessory system 100 includes a base. Tablet accessory system 100 may further include a plurality of holding straps extending from the base, the plurality of straps each forming a loop, wherein each loop is oriented on a corner of the tablet computer, wherein the plurality of holding straps are elastic, and wherein each of the plurality of holding straps engages a corner of the tablet computer at an angle so that the holding straps cross a side of the tablet computer which is acute to a portion of the side of the tablet computer closest to the corner. Tablet accessory system 100 may further include at least one accessory for attaching tablet accessory system 100 to various objects, articles, or parts of a user. Optionally, tablet accessory system 100 is attachable to a user's hand. This is realized through the use of handle 140. Optionally, handle 140 is removable. Optionally, tablet accessory system 100 is quickly converted to hanging from a lanyard on the neck or shoulder of a user. Optionally, tablet accessory system 100 may include a hook or other hanger. Optionally, tablet accessory system 100 is quickly converted from any one configuration to another.

Note that in alternative embodiments, tablet accessory system 100 may be various sizes and may fit various-sized tablet computers or other items, such as smart phones (iPhone®, Android®, etc.). Tablet accessory system 100 may be sized to fit any roughly square or rectangular phone or tablet computer. Furthermore, in one embodiment, base 105 and straps 110 are the core of the system. This core may be attached to any set of accessories for a wide range of varying uses including, but not limited to: straps, carabineers, stands, car parts, bicycle parts (such as cages and holder), backpacks, and parts associated therewith.

A variety of configurations are available to the user using the tablet accessory system 100. The user may utilize lanyard 135 to cinch the tablet computer tightly to his body and orient it on his back during an activity such as riding a bike. The user may place his hand in the handle area, allowing the user to hold the tablet computer without strain. The handle may be slid up the user's arm, freeing both hands. The S-Biner™ may be used to hang the tablet computer on a wall, attach it to a backpack, a belt, etc. The tablet may be hung from a loop or hook descending from the ceiling for ready access in a work area. It may be hung on the side of a table as well using the S-Biner™. Many of these configurations may offer significant advantage in a working situation and may prevent the tablet computer from being dropped. Moreover, the ready ability to attach the system to the user's body or clothing prevents the system from being stolen. Note that, due to the flexibility of the corner straps, a protective case with an open or closed front may be utilized with tablet accessory system 100. The corner straps may easily be flexed around such a cover and removed to open and close the front protection.

The embodiments described above and shown herein are illustrative and not restrictive. The scope of tablet accessory system 100 is indicated by the claims rather than by the foregoing description and attached drawings. Tablet accessory system 100 may be embodied in other specific forms without departing from the spirit of tablet accessory system 100. Accordingly, these and any other changes which come within the scope of the claims are intended to be embraced therein.

The invention claimed is:

1. A tablet computer accessory system for holding a tablet computer, the tablet computer accessory system comprising:

a base;

a plurality of holding straps extending from the base, the plurality of straps each forming a loop, wherein each loop can be oriented on a corner of the tablet computer;

a handle, interconnected with the base, wherein the handle is removable and the handle has a first and a second attachment portion and the handle folds around a handle strap attached to the base such that the first and second attachment portions connect;

a hanging strap, interconnected with a carabiner, the hanging strap attached to the base; and a leg strap, interconnected with the base, the leg strap interconnected via a leg strap loop, the leg strap loop located under the handle strap, the tablet computer accessory system configurable in a first configuration, where the handle is removed and the leg strap is connected via the leg strap loop and a second configuration, where the handle is attached and the leg strap is removed from the leg strap loop.

2. The tablet computer accessory system of claim 1 wherein the base is padded on a side that receives the tablet computer.

3. The tablet computer accessory system of claim 1 wherein the base has a rubberized, high friction surface on a side that receives the tablet computer.

4. The tablet computer accessory system of claim 1 wherein the plurality of holding straps are elastic, such that the plurality of holding straps stretch around the tablet computer and provide tension to hold it in place.

5. The tablet computer accessory system of claim 1 wherein there are four holding straps of the plurality of holding straps.

6. The tablet computer accessory system of claim 1 wherein the length of the loop formed by each of the plurality of holding straps is adjustable.

7. The tablet computer accessory system of claim 1, further comprising an accessory bag.

8. The tablet computer accessory system of claim 7 wherein the accessory bag is attached to the base such that the combination of the base, a tablet computer, and the accessory bag forms a stand, such that the tablet computer is positioned at an angle to a flat surface, the angle being such that the screen of the tablet computer is viewable, the accessory bag and a side of the tablet computer forming a base of the stand.

9. The tablet computer accessory system of claim 6 wherein the handle is a square piece of material with hook and loop fastener at either end and is mounted on a strap, such that the handle folds around the strap and fastens together with the hook and loop fastener.

10. The tablet computer accessory system of claim 1 wherein the handle forms a pocket for insertion of and storage of the carabiner.

11. The tablet computer accessory system of claim 1 wherein the tablet computer accessory system has four configurations: a handheld configuration, a hanging configuration, a lanyard configuration, and a leg strap configuration.

12. The tablet computer accessory system of claim 11 wherein the handheld configuration is characterized by detachment of the lanyard and leg strap and storage of the carabiner interior to the handle.

13. The tablet computer accessory system of claim 11 wherein the hanging configuration is characterized by the attachment of the carabiner to a fixed point.

14. The tablet computer accessory system of claim 11 wherein the lanyard configuration is characterized by the orientation of the lanyard around a user.

15. The tablet computer accessory system of claim 11 wherein the leg strap configuration is characterized by the removal of the handle and the detachment of the carabiner.

* * * * *